US007753516B2

(12) United States Patent
Yoneyama

(10) Patent No.: US 7,753,516 B2
(45) Date of Patent: Jul. 13, 2010

(54) INKJET RECORDING APPARATUS

(75) Inventor: Tsutomu Yoneyama, Kunitachi (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 937 days.

(21) Appl. No.: 11/583,748

(22) Filed: Oct. 19, 2006

(65) Prior Publication Data

US 2007/0097196 A1 May 3, 2007

(30) Foreign Application Priority Data

Oct. 28, 2005 (JP) ..... 2005-314590

(51) Int. Cl.
*B41J 2/01* (2006.01)

(52) U.S. Cl. ..... 347/102

(58) Field of Classification Search ..... 347/51, 347/52, 14, 102
See application file for complete search history.

(56) References Cited

U.S. PATENT DOCUMENTS 7,244,021 B2 * 7/2007 Arai ..... 347/102
7,591,536 B2 * 9/2009 Silverbrook ..... 347/42
7,651,215 B2 * 1/2010 Hoshino ..... 347/102

FOREIGN PATENT DOCUMENTS

JP 2003-285422 A 10/2003
JP 2004-306591 A 11/2004
JP 2005-059214 A 3/2005

* cited by examiner

*Primary Examiner*—Lamson D Nguyen
(74) *Attorney, Agent, or Firm*—Frishauf, Holtz, Goodman & Chick, P.C.

(57) ABSTRACT

An inkjet recording apparatus includes: a drum rotor rotating while holding recording medium on circumferential surface; a head unit disposed facing circumferential surface and movable relatively to drum rotor along axis direction, and provided with image recording head and background recording head; a light irradiating device for curing ink on recording medium, light irradiating device facing circumferential surface of drum rotor and aligned with head unit along rotation direction of drum rotor; and a control device that controls drum rotor to rotate, head unit to move along axis direction while jetting real image recording ink and background recording ink, and light irradiating device to irradiate light, wherein the control unit performs control such that, during a time after one of image recording head and background recording head has performed recording and before the other one performs recording, light irradiating device irradiates light onto ink of record generated by the one.

11 Claims, 3 Drawing Sheets

INKJET RECORDING APPARATUS

This application is based on Japanese Patent Application No. JP2005-314590 filed on Oct. 28, 2005, the entire of which is hereby incorporated by reference.

FIELD OF THE INVENTION

The present invention relates to an inkjet recording apparatus, and particularly relates to an inkjet recording apparatus using background ink.

BACKGROUND OF THE INVENTION

Conventionally, inkjet recording devices are known as recording devices capable of printing on various recording mediums, including a typical example of plain paper. An inkjet recording device forms an image on a recording medium by directly jetting inks, which are coloring materials, onto the recording medium from nozzles arranged at the surface of recording heads facing the recording medium to make the inks land on the recording medium and infiltrate into or fix on the recording medium. Such an inkjet recording device has excellent features of simplicity of process, quietness during printing, and the quality of printing characters and images.

Such an inkjet recording device generally performs printing by the use of process color inks in colors of cyan, magenta, yellow, and black. In recent years, for special printing, attempts have been made to develop a method of improving the added value of an obtained image by superimposingly printing in special colors in addition to process colors.

For example, an image forming method is known that performs printing with white ink on a transparent base material, such as a soft wrapping material or film. This image forming method performs back printing in process colors on a transparent base material and thereafter superimposingly jets white ink on the printed surface. In such a manner, the printed image is observed as a right view when viewed from the side opposite to the side to which the white ink is adhering, in other words, when viewed from the transparent base material side. Further, an effect is obtained that prevents unclear recognition of an image caused by color transparency due to the transparent base material. This printing b the use of white ink in such a manner is called back printing, since the printing is performed on the side of the base material opposite to the side from which a view is taken.

On the other hand, in the case of using a colored base material, an image printed on the base material may be affected by the color of the base material, which may inhibit recognition of a right color of the image. In such a case, printing is performed on the surface of the basic material with white ink first, and then an image is superimposedly printed with process color ink on the surface of the print of the white ink. Herein, printing by the use of white ink in such a manner is called 'front printing' because printing is performed on the side, of the base material, from which a view is taken.

Inkjet recording devices have been developed which employ an image forming method that uses inks for forming real images, such process color inks as described above, and uses also a non-process color ink as a background color, such as white ink (refer to Patent Documents 1 to 3).

(Patent Document 1) Japanese Unexamined Patent Publication TOKKAI No. 2003-285422

(Patent Document 2) Japanese Unexamined Patent Publication TOKKAI No. 2004-306591

(Patent Document 3) Japanese Unexamined Patent Publication TOKKAI No. 2005-59214

In such an inkjet recording device, recording heads (background recording heads) for jetting background recording ink are disposed at positions between which recording heads (heads) for jetting real image recording ink are disposed.

In a device disclosed in Patent Document 1, for front printing, a background recording head is disposed at a position forward from image recording heads with respect to the moving direction of the carriage, and for back printing, a background recording head is disposed at a position behind the image recording heads with respect to the moving direction of the carriage. Accordingly, in the case of performing both front printing and back printing, background recording heads are necessary on the both sides of image recording heads. In Patent Document 2, also disclosed is a device, as an example, that performs front printing with a background recording head disposed on the downstream side of image recording heads with respect to the conveying direction of a base material, and performs back printing with a background recording head disposed on the upstream side of image recording heads.

In any case where background recording heads are arranged such that image recording heads are disposed between the background recording heads along the carriage moving direction, the number of background recording heads increases and the size of the carriage becomes larger. Herein, the device disclosed in Patent Document 3 has a structure that instantly cures ink just after the ink is jetted from a background recording head so as to prevent mixing of the background recording ink with image recording ink, wherein background recording ink is cured with UV-light after being jetted from the background recording head and landing on a base material. However, such a structure further increases the size of the carriage.

Particularly, in a structure where background recording heads are disposed on the upstream and downstream sides along the direction of conveying a recording medium, the area, for printing on a base material, of the platen surface becomes large to cause a problem of lowering the conveying accuracy.

Further, in a case where ink is cured by irradiation from a UV-light irradiating device, since the arc length of the UV-light irradiating device becomes large, another problem is caused by heat development.

In this situation, in order to avoid mounting plural background recording heads on a carriage, a device has been developed in which a background recording head is mounted only on one side of image recording heads. In the case of performing front printing by this device, a background image is printed during forward motion of the carriage, and a real image is printed, during backward motion of the carriage, on the base material on which the background image has been printed.

However, even with this device, image deviation may be caused between a background image and real image, depending on the conveying accuracy.

As described above, there have been cases where high-definition recording images cannot be obtained by mounting a background recording head/heads on a carriage in addition to image recording heads.

In this situation, an object of the invention is to provide an inkjet recording apparatus that prevents lowering of conveying accuracy and prevents image deviation caused by an increase in the size of a carriage and thus achieves a high-definition image, even a background recording head is mounted on the carriage.

SUMMARY OF THE INVENTION

An inkjet recording apparatus includes:

a drum rotor that rotates while holding a recording medium on a circumferential surface thereof;

a head unit that is disposed facing the circumferential surface of the drum rotor and movable relatively to the drum rotor along an axis direction of the drum rotor, and is provided with an image recording head that jets real image recording ink and a background recording head that jets background recording ink onto the recording medium;

a light irradiating device for curing ink on the recording medium, wherein the light irradiating device is disposed facing the circumferential surface of the drum rotor and in alignment with the head unit along a rotation direction of the drum rotor; and a control device that controls the drum rotor to rotate, the head unit to move along the axis direction of the drum rotor while jetting real image recording ink from the image recording head and background recording ink from the background recording head, and the light irradiating device to irradiate light, wherein the control unit performs control such that, during a time after one of the image recording head and the background recording head has performed recording and before the other one of the recording heads performs recording, the light irradiating device irradiates light onto ink of the record generated by the one of the recording heads.

DETAILED DESCRIPTION OF THE PREFERRED EMBODIMENT

Figure 1:
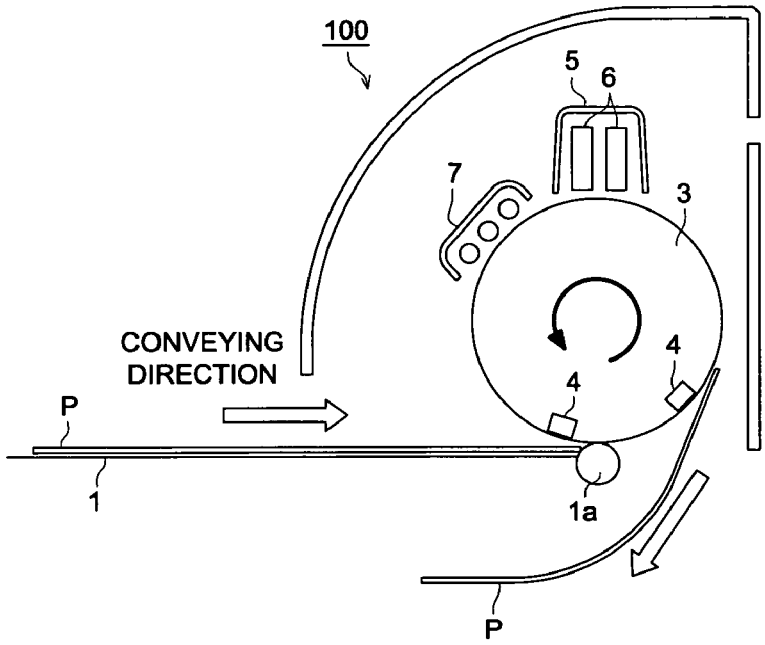
FIG. 1 is a cross-sectional side view showing a schematic structure of an inkjet recording apparatus in a first embodiment.

The present invention includes the following structures.

(1) An inkjet recording apparatus, including:

a drum rotor that holds a recording medium on the circumferential surface thereof and rotates;

a head unit provided with an image recording head that jets real image recording ink and a background recording head that jets background recording ink onto the recording medium;

a light irradiating device that irradiate light to cure ink on the recording medium, wherein the head unit and the light irradiating device are disposed, facing the circumferential surface and aligned with each other along the rotation direction of the drum rotor, and a control unit that performs control such that the drum rotor rotates and the head unit moves relatively to the drum rotor along the axis direction of the drum rotor while, during the time after one of the image recording head and the background recording head performs recording and before the other head performs recording, the light irradiating device irradiates light onto ink on the recording medium having been jetted from the one head for recording.

According to Structure (1), in a state where the head unit, drum rotor, and light irradiating device are disposed as described above, it is possible to perform control in the following manner. That is, the drum rotor rotates and the head unit moves relatively to the drum rotor along the axis direction of the drum rotor. After one of the image recording head and the background recording head jets ink, the drum rotor rotates and the ink having been jetted from the one recording head is cured on the recording medium. Thereafter, the recording head having not jetted ink jets ink. Consequently, it is possible to prevent mixing of the real image recording ink with the background recording ink, both having been jetted onto the recording medium, with the rotation of the drum rotor between the jetting. In such a manner, it is possible to properly perform recording with real image recording ink and recording with background recording ink.

Further, since ink jetting operation is performed while moving the head unit, which includes the image recording head and background recording head, relatively to drum rotor 3 along the axis direction of the drum rotor, it is not necessary to arrange background recording heads on the upstream and downstream sides of the head unit along the sub scanning direction, which achieves a smaller size of the head unit.

Further, since the recording medium is wound around drum rotor to be conveyed, ink jetting operation is possible without the necessity of considering problems, such as a drop in the conveying accuracy and heat generated by the light source, which could be degraded by an increase in the size of the head unit.

Further, since the image recording head and background recording head are integrally arranged to form the head unit, it is possible to move the image recording head and background recording head simultaneously when moving the head unit, and thus image deviation between an image recorded with the image recording head and an image recorded with the background recording head can be prevented.

(2) The inkjet recording apparatus of Structure (1), wherein, the apparatus is provided with a back recording mode and front recording mode as jetting operation modes; and the control unit starts ink jetting operation with the image recording head in the back recording mode, and starts ink jetting operation with the background recording head in the front recording mode.

According to Structure (2), the apparatus is provided with the front recording mode and back recording mode, as two types of recording modes. In the back recording mode, back recording is performed on the recording medium such that the background recording head jets ink after the image recording head jets ink. In the front recording mode, front recording is performed on the recording medium such that the image recording head jets ink after the background recording head jets ink.

(3) The inkjet recording apparatus of Structure (1) or (2), wherein the background recording ink is non-process color ink.

According to Structure (3), the background recording ink is non-process color ink. Therefore, for example, by the back recording mode, it is possible to form a background image with the non-process color ink after forming a real image with the real image recording ink. Further, by the front recording mode, it is possible to form a real image after forming a background image.

(4) The inkjet recording apparatus of Structure (3), wherein the non-process color ink is white ink or clear ink.

According to Structure (4), the non-process color ink is white ink or clear ink. Therefore, for example, in the case of using white ink as the non-process color ink in the back recording mode, it is possible to form a background image on a transparent base material after forming a real image. Further, it is possible to form a real image after forming a background image in the front recording mode. Even when a colored base material is used, it is possible to form an image in a desired color regardless of the color of the base material.

(5) The inkjet recording apparatus of any one of Structures (1) to (4), wherein the background recording head and the image recording head are disposed sequentially along the axis direction of the drum rotor.

According to Structure (5), it is possible to achieve the same effects as those by Structures (1) to (4), by disposing the background recording head and the image recording head sequentially along the axis direction of the drum rotor.

First Embodiment

A first embodiment in accordance with the invention will be described below, referring to FIGS. 1 to 6.

FIG. 1 is a cross-sectional side view showing a schematic structure of an inkjet recording apparatus 100 in the present embodiment.

In inkjet recording apparatus 100, a recording medium P is conveyed into inkjet recording apparatus 100, and support member 1 is provided in the inkjet recording apparatus 100 to support inserted recording medium P from the bottom.

Roller 1*a* for conveying recording medium P is provided at the end of support member 1 on the downstream side in the direction (the sub-scanning direction) conveying recording medium P. On the upper side of roller 1*a*, rotor (drum rotor) 3 formed in a drum shape is arranged roratably with rotation mechanism 2 (refer to FIG. 6), described later, and extending in the axis direction (hereinafter, referred to as the main scanning direction).

Chucking mechanism 4 for sandwiching the recording medium P is fitted on the inner circumferential surface of drum rotor 3. Chucking mechanism 4 is arranged with a pair of members that sandwich the edge on the downstream-side and the edge on the upstream-side, in the conveying direction, of recording medium P. When rotation mechanism 2 rotates drum rotor 3, the pair of members sandwiches the edge on the downstream side, in the conveying direction, of recording medium P having been conveyed from a sheet feeding tray, and then sandwiches the edge on the upstream side, in the conveying direction, of recording medium P as drum rotor 3 rotates. Accordingly, recording medium P can be held being wound on the outer circumferential surface of rotor 3 by chucking mechanism 4 during the rotation of drum rotor 3. Herein, recording medium P applicable to inkjet recording apparatus 100 is in a size smaller than the length of the outer circumference of rotor 3.

Herein, although the chucking mechanism 4 holds recording medium P by sandwiching, chucking mechanism 4 may have a structure that generates static electricity to absorb drum rotor 3, or sucks and absorbs drum rotor 3 with vacuum.

Further, at a position facing the outer circumferential surface of drum rotor 3, a pair of guide rails (not shown) is provided extendingly in the main scanning direction. Guide rails hold head unit 5 reciprocatively in the main scanning direction.

Plural recording heads 6 for jetting ink are mounted on head unit 5, wherein the ink jetting face of each recording head 6 is disposed facing recording medium P on the drum rotor 3, and the position of the ink jetting face is adjusted such that ink jetted from recording head 6 lands on a predetermined position of recording medium P on drum rotor 3.

Figure 2:
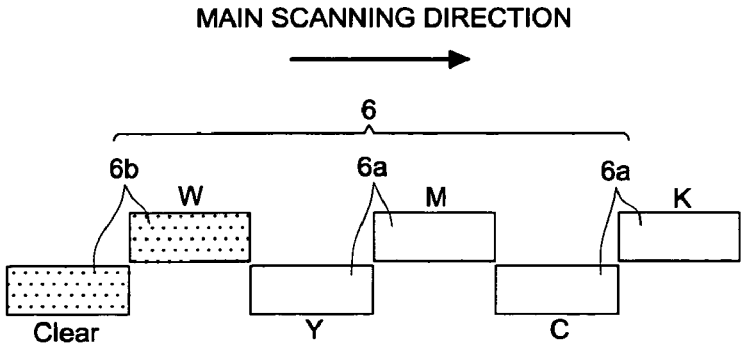
FIG. 2 is a top view showing a structure of a head unit of the apparatus in FIG. 1.

Herein, the plurality of recording heads 6 are image recording heads 6*a* for jetting process color ink and background recording heads 6*b* for jetting non-process color ink as background recording ink. As shown in FIG. 2, nozzle arrays are formed along the main scanning direction such that recording heads for jetting a clear (Clear) ink and white (W) ink as non-process color inks and recording heads for jetting a Magenta (M), cyan (C) and black (K) ink as process color inks are sequentially disposed in a staggered pattern.

Herein, photo-curable ink (such as polymerized ink, cation polymerized ink, and hybrid type ink) is preferably used for inkjet recording apparatus 100 in accordance with the invention. In the present embodiment, preferably used is, in particular, energy-accumulation-type cation polymerizable ink which is little inhibited by oxygen from polymerization reaction and can be cured even by irradiating a low-intensity UV-light for a long time.

Figure 3:
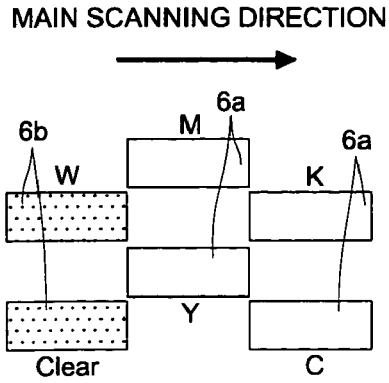
FIG. 3 is a top view showing a structure of a head unit in another pattern.
Figure 4:
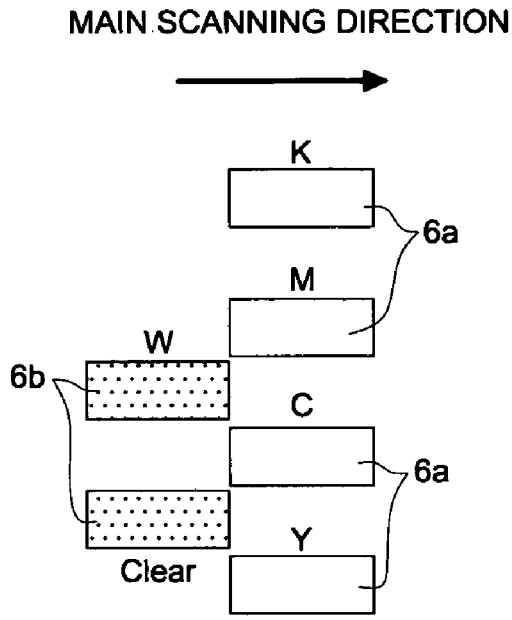
FIG. 4 is a top view showing a structure of a head unit in still another pattern.

Herein, the disposition pattern of image recording heads 6*a* and background recording heads 6*b* may be one shown in FIG. 2 or other patterns, such as shown in FIGS. 3 and 4.

In FIG. 3, background recording heads 6*b* for jetting non-process color ink and image recording heads 6*a* for jetting process color ink are disposed along the main scanning direction, as same as in FIG. 2. However, head unit 5 is constructed with a first head unit on which recording heads 6 for white (W), magenta (M), and black (K) inks are sequentially disposed in a staggered pattern along the main scanning direction, and a second head unit, in parallel to the first head unit, on which recording heads 6 for clear (Clear), yellow (Y), and cyan (C) inks are sequentially disposed in a staggered pattern.

Also in FIG. 4, recording heads 6*b* for jetting non-process color ink and recording heads 6*a* for jetting process color ink are disposed along the main scanning direction, as same as in FIGS. 2 and 3. However, head unit 5 is constructed with a third head unit on which recording heads 6 for jetting process color ink are disposed parallel to each other and a fourth head unit on which recording heads 6 for jetting non-process color ink are disposed parallel to each other.

Further, at a position facing the outer circumferential surface of drum rotor 3, a pair of guide rails (not shown) is provided on the downstream side of head unit 5 with respect to the conveying direction of recording medium P, extendingly in the main scanning direction. The guide rails hold light irradiating device 7 reciprocatively in the main scanning direction.

The light irradiating device 7 irradiates light capable of curing ink and is provided with a light source therein. The light source to be used for light irradiating device 7 can be a fluorescent lamp, mercury lamp, metal halide lamp or the like that irradiates UV light, electron ray, X ray, visual light, infrared light or the like. In the present embodiment, UV light is employed as the light source.

Figure 5:
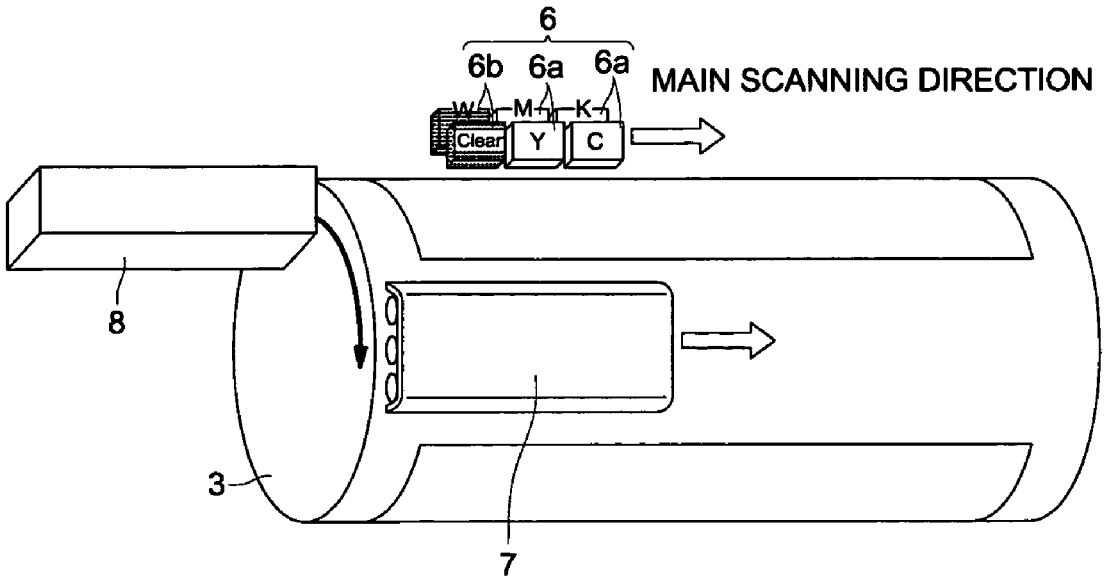
FIG. 5 is a diagram illustrating motions of the head unit and a light irradiating device relative to a drum rotor in the embodiment shown in FIG. 1.

Maintenance unit 8 is provided lateral to drum rotor 3. Herein, as shown in FIG. 5, maintenance unit 8 is disposed on the left side in FIG. 5. The following description will be made assuming that the side where maintenance unit 8 is disposed is the home position of head unit 5 and light irradiating device 7, with respect to drum rotor 3.

Now, a control structure of inkjet recording apparatus 100 will be described.

Figure 6:
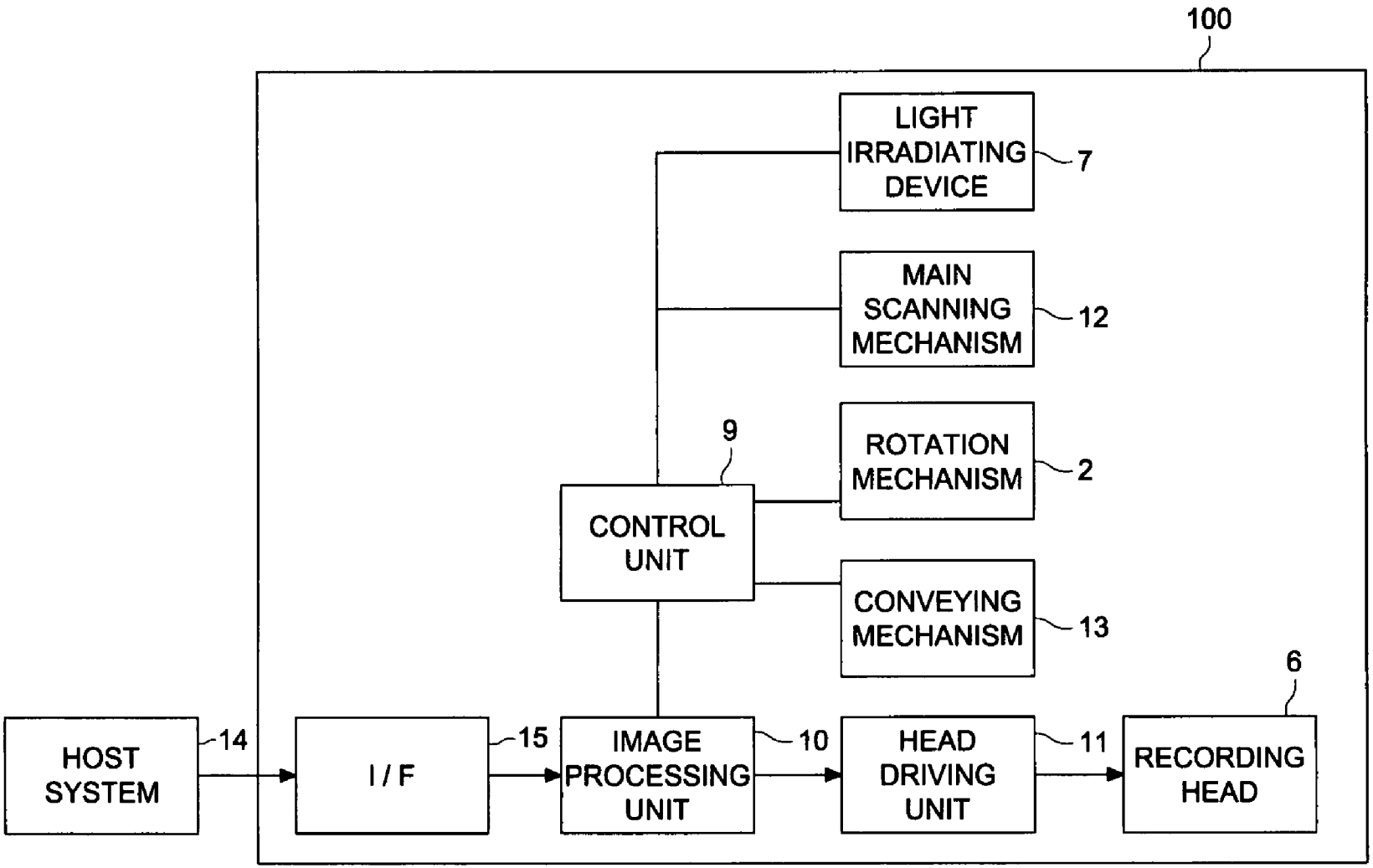
FIG. 6 is a block diagram showing a control structure of the apparatus shown in FIG. 1.

As shown in FIG. 6, inkjet recording apparatus 100 includes control unit 9 that is electrically connected to above described recording heads 6 and light irradiating device 7 as well as image processing unit 10, head driving unit 11 for driving recording heads 6, main scanning mechanism 12, rotation mechanism 2, and conveying mechanism 13. Control unit 9 controls the drive of the above respective elements.

Image processing unit 10 decodes encoded input image data transmitted through interface (I/F) 15 from host system 14 connected via a network into a data format processable by inkjet recording apparatus 100, and transmits the decoded data to head driving unit 11. Host system 14 transmits image data for recording to inkjet recording apparatus 100 and transmits input for overall operation control of inkjet recording apparatus 100 including selection of a jetting operation mode. Jetting operation modes are provided to enable selection of an ink jetting operation by inkjet recording apparatus 100, depending on a purpose. In the present embodiment, a front recording mode for front recording on recording medium P and a back recording mode for back recording are provided.

Herein, when white ink is used in the back recording mode and recording medium P is a transparent base material, a background image can be recorded after a real image is recorded on the transparent base material. When white ink is used in the front recording mode and recording medium P is a colored base material, a real image can be formed after forming a background image. That is, it is possible to form an image in a desired color regardless of the color of the base material.

Head driving unit 11 records data that is related to a recording image obtained by image processing unit 10, based on a signal transmitted from control unit 9, in such a manner that head driving unit 11 controls jetting of ink from nozzles of each recording head 6, applying a pulse voltage to a piezoelectric element of recording head 6.

Main scanning mechanism 12 is provided with a driving motor (not shown) for driving head unit 5 and light irradiating device 7. Control unit 9 controls the drive of the driving motor so that head unit 5 and light irradiating device 7 scan in the main scanning direction along the guide rails. Main scanning mechanism 12 makes head unit 5 and light irradiating device 7 scan in synchronization with each other in the main scanning direction. In such a manner, light can be irradiated from light irradiating device 7 onto ink on recording medium P having been jetted from recording heads 6 of head unit 5, to cure the ink.

Conveying mechanism 13 is provided with a conveying motor that periodically rotates to convey recording medium P into inkjet recording apparatus 100 at a predetermined unit amount of conveying and a conveying roller (neither is shown). Control unit 9 controls the drive of the conveying motor to convey recording medium P into inkjet recording apparatus 100 one by one.

Rotation mechanism 2 is provided with a driving motor (not shown) for driving drum rotor 3 to rotate it at a predetermined rotational speed and a driving motor (neither is shown) which operates chucking mechanism 4 to cause drum rotor 3 to hold recording medium P when drum rotor 3 reaches a predetermined rotation speed and to release the holding of recording medium P after image recording. Control unit 9 controls the drive of these driving motors so that drum rotor 3 holds recording medium P and rotates while holding recording medium P.

Herein, rotation mechanism 2 is an element of the conveying mechanism of inkjet recording apparatus 100. The following description will be given in distinction between conveying of recording medium P by rotation mechanism 2 and conveying of recording medium P by another mechanism, and the conveying mechanism for recording medium P other than rotation mechanism 2 will be referred to as conveying mechanism 13.

Control unit 9 includes a CPU, ROM, RAM (None of them are shown.) and the like, and loads a processing program recorded in the ROM into the RAM to execute the processing program with the CPU.

Specifically, control unit 9 performs control to transmit an instruction signal of a jetting operation mode having been set via host system 14 to main scanning mechanism 12, and to put head unit 5 and light irradiating device 7 on standby at the home position until the start of recording.

When a jetting operation mode is set via host system 14 during recording operation, control unit 9 controls to quickly move head unit 5 and light irradiating device 7 to predetermined positions immediately after recording, according to the designated mode, to put them on standby. For example, in a case of performing back recording continuously, these members are moved to the home position and put on standby, and in a case of performing front recording after back recording, these members are moved to a position opposite to the home position after termination of back recording and put on standby.

Further, control unit 9 performs control to transmit instruction signals, such as signals for a jetting operation mode and a driving frequency having been set via host system 14, to head driving unit 11, to apply a pulse voltage to the piezoelectric element of each recording head 6 from head driving unit 11, based on predetermined image recording information, and to jet ink from the nozzles of recording head 6 at a predetermined frequency.

Still further, control unit 9 controls conveying mechanism 13 to convey recording medium P in the sub scanning direction, and controls rotation mechanism 2 to rotate drum rotor 3.

Yet further, control unit 9 controls main scanning mechanism 12 to relatively move head unit 5 and light irradiating device 7 along the main scanning direction at the time of image recording, as shown in FIG. 5.

Hereinafter, categorizing the recording heads in the present embodiment for better understanding, the plurality of the image recording heads **6*a* will be collectively referred to as the image recording head group, and the plurality of the background recording heads 6*b*** will be collectively referred to as the background recording head group.

Control unit 9 further performs controls in the following manner. That is, drum rotor 3 rotates and head unit 5 relatively moves along the axis direction of drum rotor 3, while one of the image recording head group and background recording head group performs recording at a position, and thereafter the other one of the recording head group having reached the same position after rotations of the drum rotor 3, performs recording, wherein during the time after the recording by the one head group and before the recording by the other head group, light is irradiated from the light irradiating device onto the ink jetted from the one head group. That is, control unit 9 is capable of forming an image in an area corresponding to head unit 5 on the recording medium P by rotation of drum rotor 3 with rotation mechanism 2.

In the present embodiment, the above described image recording head group is formed by the plural image recording heads **6*a* that respectively jet yellow (Y), magenta (M), cyan (C), and black (K) color inks, and the background recording head group is formed by the plural background recording heads 6*b*** that respectively jet clear (Clear) and white (W) inks. However, the invention is not limited thereto. Either or both the recording head groups may be a single recording head. The image recording head group may be a single image recording head for jetting black (K) ink, for example. Further, the background recording head group may be a single background recording head for jetting white (W) ink, for example.

Still further, control unit 9 performs control to transmit an instruction signal of a jetting operation mode having been set via host system 14 to head driving unit 11, and to start ink jetting from a determined recording head group, according to the jetting operation mode having been set.

Herein, in a case where the set jetting operation mode is the back recording mode, head driving unit 11 is controlled to start ink jetting operation with image recording head 6*a*. On the other hand, in a case where the set jetting operation mode is the front recording mode, head driving unit 11 is controlled to start ink jetting operation with a background recording head 6*b*. Thus, even if background recording heads 6*b* are not disposed on the both sides with image recording heads 6*a* therebetween, it is possible to perform both front recording and back recording.

Further, control unit 9 controls rotation mechanism 2 to rotate the drum rotor 3 during ink jetting operation by image recording heads 6*a* and background recording head 6*b*.

Next, the operation of inkjet recording apparatus 100 will be described.

When a jetting operation mode is input via host system 14 and input image data is transmitted to image processing unit 10 from host system 14 via I/F 15, control unit 9 performs control to move head unit 5 and light irradiating device 7 to predetermined positions, according to the jetting operation mode, and put them on standby until a start of image recording.

Herein, in a case where the back recording mode is input via host system 14, control device 9 puts head unit 5 and light irradiating device 7 on standby at the home position. On the other hand, when the front recording is input, the control device puts head unit 5 and light irradiating device 7 on standby at the position opposite to the home position with drum rotor 3 between these two positions.

Then, control unit 9 controls rotation mechanism 2 to rotate drum rotor 3.

When drum rotor 3 reaches a predetermined rotation speed, control unit 9 controls conveying mechanism 13 to convey recording medium P onto support member 1. Thereafter, when the front edge of recording medium P reaches roller 1*a*, recording medium P is sandwiched by chucking mechanism 4 to be held on the circumferential surface of drum rotor 3. Accordingly, recording medium P is rotated with the rotation of drum rotor 3.

Then, control unit 9 controls head driving unit 11 to jet ink from recording heads 6, based on the image data having been input from image processing unit 10.

In the case of back recording, first, real image recording ink jetted from an image recording head 6*a* records a real image, and subsequently, UV irradiation by the light irradiating device 7 instantly cures the real image recording ink. This operation is repeated for plural rotations. Thus, a real image is recorded in an area, of the recording medium, corresponding to a position of the head unit 5, then a background is recorded with background recording ink jetted from a background recording head 6*b* having moved to the above described area, and subsequently, the background ink is cured by UV irradiation. This operation, namely recording by the background recording head and curing by UV irradiation, is repeated for plural rotations so that background recording for the entire of the above described area is carried out. In such a manner, a real image is already cured when background image recording starts in the same area, which achieves real image recording and background recording without mixing of real image recording ink and background recording ink. Herein, ink is jetted from recording heads moving 6*a* and a background recording head 6*b* in the main scanning direction while the drum rotor 3 is rotating, and accordingly, recording is carried out each time along a spiral curve on the recording medium P held on the circumferential surface of the drum rotor 3. Since the transportation speed of the head unit 5 in the main scanning direction is not changed during recording, real image recording is continuously carried out with an image recording head in an area located forward, in the main scanning direction, from the above described area where background recording is currently carried out.

When one main scan of the head unit 5 in the main scanning direction is completed through real image recording and background recording, image recording has been carried out over the entire width of the recording medium P, thereby completing image recording.

Similar operation is performed also for front recording. However, in the case of front recording, main scanning of the head unit 5 is started from the side opposite to the home position along the axis direction of the drum rotor 3. Similarly to the case of background recording, the head unit 5 moves at a constant speed in the main scanning direction. In an area corresponding to a position of the head unit 5, first, ink jetting from a background recording head and curing of the ink with UV light are carried out in one rotation, and this operation is repeated for plural rotations, thereby completing background recording in the above described area. Thereafter, image recording ink is jetted from a real image recording head having moved to the above described area and the ink is cured with UV light. This operation is carried out in one rotation, and the operation is repeated for plural rotations, thereby completing real image recording in the above described area.

In the present embodiment, the head unit 5 is continuously moved in the main scanning direction. However, it is also possible to move the head unit 5 intermittently. In this case, recording is performed with ink jetted from recording heads while the head unit 5 is stopped and the drum rotor 3 is rotating, and consequently recording is carried out each time along a circular arch on the recording medium held on the circumferential surface of the drum rotor 3.

Thereafter, when one main scan in the main scanning direction is completed, image recording is carried out on the entire lateral area of recording medium P and image recording is completed. Then, holding of recording medium P by the chucking mechanism 4 is released and the recording medium P having an image recorded thereon is collected.

In a case where a mode is designated via host system 14 during recording operation, control unit 9 quickly moves heat unit 5 and light irradiating device 7 to a predetermined position immediately after recording, according to the designated mode. For example, in a case of performing back recording continuously, these members are moved to the home position and put on standby, and in a case of performing front recording after back recording, these members are put on standby at the position after completion of back recording, namely, the position opposite to the home position.

As described above, with inkjet recording apparatus 100 in the present embodiment, after ink is jetted from one of the image recording head 6*a* group and the background recording head 6*b* group, rotation operation is made, and ink jetted from the one head group 6 is cured on recording medium P, and then ink is jetted from the other recording head 6 group which has not yet jetted ink. In such a manner, while preventing mixing of real image recording ink and background recording ink which are jetted onto recording medium P with the rotation operation between these jetting operations, recording with real image recording ink and recording with background recording ink can be properly carried out.

Further, since ink jetting operation is performed while moving head unit 5, which includes image recording heads 6*a* and background recording heads 6*b*, relatively to drum rotor 3 in the main scanning direction, it is not necessary to arrange background recording heads on the upstream and downstream sides of the head unit along the sub scanning direction, which achieves a smaller size of head unit 5.

Further, since the recording medium is wound around drum rotor 3 to be conveyed, ink jetting operation is possible without the necessity of considering problems, such as a drop in the conveying accuracy and a generation of heat by the light source which could occur to a greater extent with an increase in the size of head unit 5.

Further, since image recording heads 6*a* and background recording heads 6*b* are integrally arranged to form head unit 5, it is possible to move image recording heads 6*a* and background recording heads 6*b* simultaneously when moving head unit 5, and thus image deviation between an image recorded with image recording head 6*a* and image recorded with background recording head 6*b* can be prevented.

Consequently, in accordance with the present invention, an inkjet recording apparatus provided with a drum rotor that rotates while holding a recording medium is capable of image forming in high definition, and a head unit can be miniaturized to prevent the size of the entire apparatus from becoming larger, even if the apparatus is provided with image recording heads and background recording heads.

In the present embodiment, the control unit 9 rotates the drum rotor 3 with the rotation mechanism 2 for plural rotations so as to form an image in an area corresponding to a position of the head unit 5, and repeats this operation, thereby completing image recording, namely both real image recording and background recording, over the entire width of the recording medium. However, it is also possible, in the case of back recording for example, to jet real image recording ink from image recording heads 6*a* and cure the jetted ink (real image recording ink) by the light emitting device 7 through forward moving, thereby recording a real image over the entire width of the recording medium through forward moving, and thereafter, jet background recording ink from a background recording head 6*b* and cure the jetted ink (background recoding ink) with the light emitting device 7 through backward moving, thereby recording a background through backward moving over the entire width of the recording medium, and in such a manner, recording of a real image and background is completed.

Further, although, in the present embodiment, light irradiating device 7 is arranged corresponding to head unit 5, and light irradiating device 7 and head unit 5 are moved in synchronization with each other, as shown in FIG. 5, it is also possible to arrange a light irradiating device in a size corresponding to the width of the drum rotor 3 in the main scanning direction.

What is claimed is:

1. An inkjet recording apparatus, comprising:

a drum rotor that rotates while holding a recording medium on a circumferential surface thereof;

a head unit that is disposed facing the circumferential surface of the drum rotor and movable relatively to the drum rotor along an axis direction of the drum rotor, and is provided with an image recording head that jets real image recording ink and a background recording head that jets background recording ink onto the recording medium;

a light irradiating device for curing ink on the recording medium, wherein the light irradiating device is disposed facing the circumferential surface of the drum rotor and in alignment with the head unit along a rotation direction of the drum rotor; and a control device that controls the drum rotor to rotate, the head unit to move along the axis direction of the drum rotor while jetting real image recording ink from the image recording head and background recording ink from the background recording head, and the light irradiating device to irradiate light, wherein the control unit performs control such that, during a time after one of the image recording head and the background recording head has performed recording and before the other one of the recording heads performs recording, the light irradiating device irradiates light onto ink of the record generated by the one of the heads.

2. The inkjet recording apparatus of claim 1, wherein the control device controls the head unit to continuously move along the axis direction of the drum rotor while forming the real image and background along a spiral curve on the recording medium held on the circumferential surface of the drum rotor.

3. The inkjet recording apparatus of claim 1, wherein the control device controls the head unit to intermittently move along the axis direction of the drum rotor while forming the real image and background at respective stop positions of the head unit along a circumferential circular arc on the recording medium held on the circumferential surface of the drum rotor.

4. The inkjet recording apparatus of claim 1, wherein the apparatus is provided with a back recording mode and front recording mode as jetting operation modes; and the control unit starts ink jetting operation with the image recording head in the back recording mode, and starts ink jetting operation with the background recording head in the front recording mode.

5. The inkjet recording apparatus of claim 1, wherein the light irradiation device is movable relatively to the drum rotor along the axis direction of the drum rotor; and the control unit controls the light irradiating device to move in synchronization with the head unit while irradiating light.

6. The inkjet recording apparatus of claim 1, wherein the background recording ink is non-process color ink.

7. The inkjet recording apparatus of claim 6, wherein the non-process color ink is white ink or clear ink.

8. The inkjet recording apparatus of claim 1, wherein the background recording head and the image recording head are disposed sequentially along the axis direction of the drum rotor.

9. The inkjet recording apparatus of claim 1, wherein the head unit is provided with a plurality of image recording heads that jet real image recording inks in respective colors.

10. The inkjet recording apparatus of claim 1, wherein the head unit is provided with a plurality of background recording heads that jet respective types of background recording inks.

11. The inkjet recording apparatus of claim 1, wherein the light irradiating device has length corresponding to a length of the drum rotor along the axis direction, and is set at a fixed position.

* * * * *